United States Patent [19]

Halse

[11] 4,113,281

[45] Sep. 12, 1978

[54] CONTINUOUS BUSINESS FORMS ASSEMBLY

[75] Inventor: Per Weien Halse, Oslo, Norway

[73] Assignee: Moore Business Forms, Inc., Niagara Falls, N.Y.

[21] Appl. No.: 821,223

[22] Filed: Aug. 2, 1977

Related U.S. Application Data

[63] Continuation-in-part of Ser. No. 727,518, Sep. 28, 1976.

[51] Int. Cl.[2] ..... B41L 1/20

[52] U.S. Cl. ..... 282/11.5 A

[58] Field of Search ..... 282/11.5 R, 11.5 A, 282/12 A, 19 R

[56] References Cited

U.S. PATENT DOCUMENTS

| | | | |
|---|---|---|---|
| 2,400,356 | 5/1946 | Kerr et al. | 282/24 R |
| 2,907,585 | 10/1959 | Sornberger et al. | 282/11.5 R |
| 3,877,728 | 4/1975 | Herz | 282/12 A X |
| 3,916,051 | 10/1975 | Wakeman | 282/11.5 R X |

FOREIGN PATENT DOCUMENTS

| | | | |
|---|---|---|---|
| 1,461,492 | 11/1966 | France | 282/11.5 R |
| 1,172,283 | 6/1964 | Fed. Rep. of Germany | 282/11.5 A |
| 501,396 | 2/1939 | United Kingdom | 282/11.5 A |

*Primary Examiner*—Willie G. Abercrombie

*Attorney, Agent, or Firm*—Watson, Cole, Grindle & Watson

[57] ABSTRACT

A series of detachable business forms are adapted to be fed through the printing means of a business machine and each include a continuous pair of superimposed outer webs having spaced transverse lines of weakening to facilitate detachment. Intermediate webs forming a booklet disposed between the outer webs are secured to only one of the outer webs and are diecut transversely at the spaced transverse lines so that separation occurs only at the outer webs. At the end of a printing run the second to the last printed form may be separated from the last printed form along a longitudinal separation line of the one web, and the one web and its attached booklet of the last printed form may be removed from the other web thereof so that such other web is left as a drive web for the unprinted forms.

3 Claims, 3 Drawing Figures

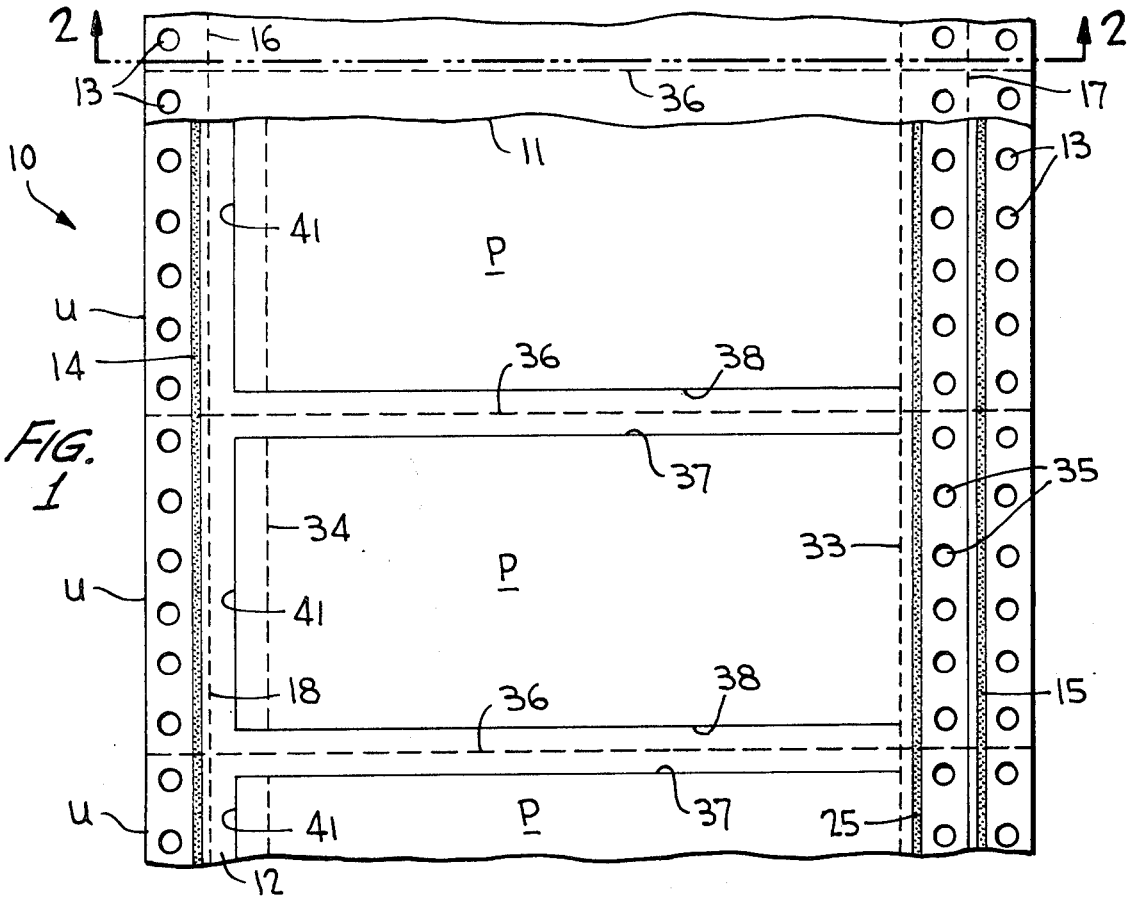
FIG. 1
FIG. 2
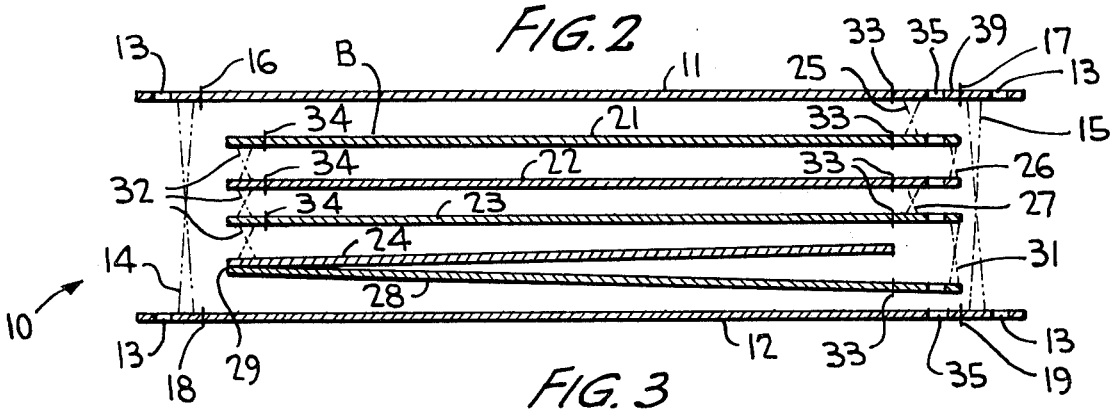
FIG. 3
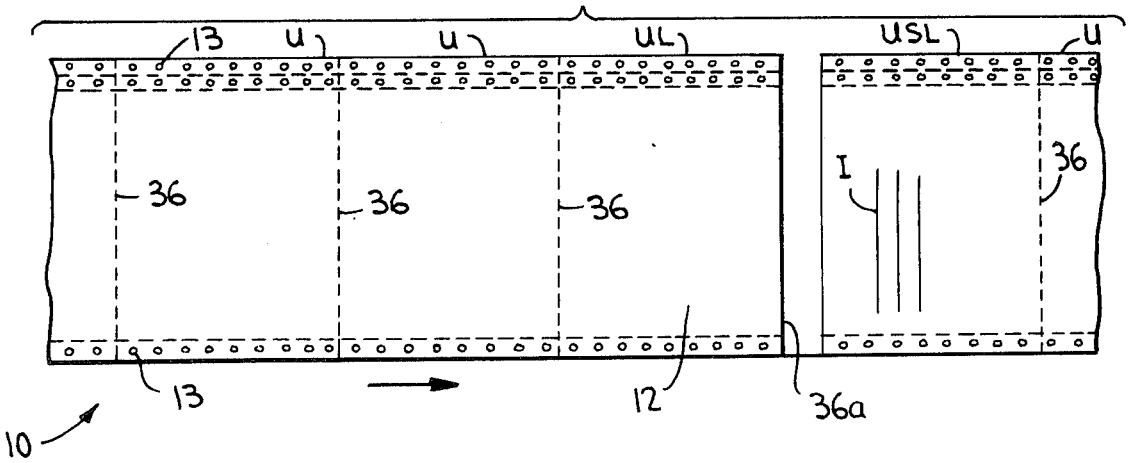

CONTINUOUS BUSINESS FORMS ASSEMBLY

RELATED APPLICATION

This application is a continuation-in-part of U.S. Ser. No. 727,518, filed Sept. 28, 1976.

BACKGROUND OF THE INVENTION

As discussed in the aforementioned application with each printing run of series-connected business forms, the leading unprinted form is wasted when by necessity it must be located slightly downstream of the print position, relative to the printer, in order to engage the tractor units.

SUMMARY OF THE INVENTION

The present invention is a further development of a continuous business forms assembly which serves to avoid the wasting of a form length each time the assembly is fed into the print unit of a business machine. In accordance with the invention, at least one web having spaced transverse diecuts is disposed between outer continuous webs and is secured to only one of such outer webs which likewise has a line of separation thereon to facilitate removal of the one outer web and its attached intermediate web. The diecut intermediate web presents edges spaced inwardly from transverse lines of perforations provided in the outer webs, whereby the form can be separated into individual units. Hence, at the end of a printing run, the next to the last of such units may be separated from the remainder on the transverse lines whereafter the last of such units has its upper outer web and attached intermediate web removed from its lower outer web which is thereby left for forming a drive web for a fresh run of an unprinted assembly to the printer.

BRIEF DESCRIPTION OF THE DRAWINGS

FIG. 1 is a plan view showing a part of the continuous business forms assembly according to the invention, partly broken away to illustrate the details thereof;

FIG. 2 is a cross-sectional view of the assembly taken substantially along line 2—2 of FIG. 1; and FIG. 3 is a plan view on a reduced scale of the FIG. 1 assembly showing the manner of providing a drive web for the unprinted forms assembly to be fed through the printer.

DETAILED DESCRIPTION OF THE INVENTION

Turning now to the drawings wherein like reference characters refer to like and corresponding parts throughout the several views, a continuous business forms assembly is generally designated 10 in FIGS. 1 to 3 and comprises continuous upper and lower webs 11 and 12 in overlying relationship and having substantially the same width. Similarly as in the aforementioned U.S. Ser. No. 727,518, assembly 10 hereof is provided with rows of spaced feed holes 13 in outer webs 11 and 12 along the opposite marginal webs respectively in superimposed relationship. Such feed holes are arranged to engage the feed means of a business machine (not shown) for advancing the business form into and past the printing means (also not shown). Lines of securement which may be in the form of longitudinal lines 14 and 15 of adhesive are disposed adjacent the rows of feed holes for securing the outer webs together along their marginal edges. Otherwise, securement means such as longitudinal rows of paper staples, as shown in British Pat. No. 1,376,447, may be provided in lieu of the lines of adhesive for attaching the outer webs together along their marginal edges. Longitudinal lines of perforations 16 and 17 are provided in upper web 11 slightly inwardly of their respectively adjacent lines 14 and 15 of adhesive and, corresponding and underlying lines 18 and 19 of perforations may be provided in lower web 12.

A plurality of intermediate webs 21, 22, 23 and 24 are superimposed between outer webs 11 and 12, transfer material such as carbon black being provided wholly or in part on the underside surfaces of webs 11, 21, 22 and 23 for transferring indicia which is printed or is otherwise applied to the upper surface of web 11 through the bottom most intermediate web 24. Otherwise, carbonless transfer material of a known variety may be applied to mating surfaces of webs 21, 22, 23 and 24 so as to produce colored marks during a reaction between reactive components thereof upon application from a writing or printing stylus to the top surface of web 11 for effecting the transfer of indicia through the intermediate webs.

Web 21 is secured to only the underside of web 11 by means of a longitudinal line 25 of adhesive or by other means of securement such as the paper staples mentioned above. Intermediate webs 22 and 23 are secured along lines 26 and 27 of adhesive respectively to the undersides of their overlying webs, lines 25 to 27 of adhesive being staggered, if desired, to avoid a direct overlay of adhesive between webs. The bottom most intermediate web is shown in FIG. 2 as being of the fan-fold variety by having a front cover 28 in underlying relationship thereto and connected to web 24 along a fold line 29. Cover 28 is secured as along a line 31 of adhesive to the underside of web 23. The opposite marginal edges of intermediate webs 21 to 24 are likewise secured together as along lines 32 of adhesive which may be laterally offset from one another to avoid bunching between lines of adhesive. Superimposed longitudinal lines 33 of perforations are provided in webs 11, 21, 22, 23 and 28 slightly inwardly of lines 25 to 27 of adhesive, and superimposed longitudinal lines 34 of perforations are provided in webs 21, 22 and 23 slightly inwardly of lines 32 of adhesive. And, another row of feed holes 35 is provided in superimposed relationship in webs 11, 21, 22, 23, 28 and 12 slightly inwardly of lines 17 and 19 of perforations for the purpose of assembling the parts of the business form together as these feed holes engage the feed means of the business machine during the assembling process.

Unlike the construction disclosed in the aforementioned related application, the intermediate webs herein are not fully continuous in a longitudinal direction but are diecut in the vicinity of the spaced transverse lines of weakening 36 provided in webs 11 and 12. The diecut intermediate webs define plies having opposing edges 37 and 38 lying inwardly of their adjacent lines 36 of weakening and extending from lines 33 of perforations so that a removable stub 39 is defined interconnecting the plies of one web together. These plies are further delimited by free edges 41 lying inwardly of lines 16 and 18 of perforations.

As can be seen, the assembly is severable into individual units U along transverse lines 36 of weakening with each of the units containing a booklet B of plies P formed from the intermediate webs and from cover web 28.

In operation, the series of connected business forms 10 is advanced past the printing means of the business machine in the direction of the arrow shown in FIG. 3 as the feed pins of the tractors engage feed holes 13 along opposite marginal edges thereof. After a printing run (see indicia I in FIG. 3), the connected printed forms are separated (burst) as in any normal manner along transverse lines 36 of weakening to separate them into individual units U with the feed bands delimited by lines 16, 18, 17 and 19 of perforations, being removed. Booklet B for each unit may then be removed therefrom together with the upper ply formed of web 11 by separation along lines 33 of perforations. The booklet, which may be an airline ticket booklet or the like will then be automatically separated from the upper ply of web 11, and the booklet cover formed of web 28 may then be folded over the top part of the booklet. Thereafter, this top part and the underlying parts formed of webs 22 and 23 may be removed from the booklet along lines 34 of perforations when desired.

After the form is printed and is fed by the tractor pin feed devices to the out feed side of the tractor, a predetermined length of the various printed units are separated from the unprinted assembly along a superimposed pair of transverse lines 36 of weakening. In accordance with the invention, after the desired number of units U of the series of connected forms have been printed, the second to the last unit USL of this printed series is separated from the last printed unit UL of forms along transverse lines 36*a* of weakening. Web 11 of unit UL may then be removed together with its underlying booklet B along line 16 as well as along lines 33 of perforations. Carrier web 12 of unit UL therefore remains together with its feed bands, delimited by lines 16, 18 and 17, 19 of perforations, connected to the leading unprinted units U of the assembly. This portion of the carrier web of the unit UL therefore serves as a drive unit for the unprinted assembly at such time as the assembly is to be printed during a subsequent printing run. The entire unprinted assembly may be removed from the business machine and, when the assembly is reloaded thereinto, the leading unit is UL rather than an unprinted unit U so that the entire assembly may now be advanced to the printing unit of the business machine without wasting a leading unit since its upper web and underlying booklet are already printed and removed.

One of the advantages with the use of the construction as aforedescribed is that web 11 and the underlying booklet B associated with a particular unit U may be separated therefrom along a single transverse tear line 36. Carrier web 12 may remain unseparated since it carries no indicia. Otherwise, if the units are to completely burst from one another such may be carried out by separation along only a pair of superimposed tear lines 36 provided in the upper and lower webs. In any event, the intermediate webs are not separated from one another along transverse tear lines as heretofore required. The cross-tearing of only part 11, or further of part 12, also eliminates the risk of damaging the parts of the booklet, and the final ticket booklet will have clean edges and be more presentable as compared to those having perforated edges. It should also be pointed out that booklet B may be used as a ticket-by-mail construction after it is removed from its unit.

In the afore described embodiment the number of parts of the unit and the types and locations of the transfer means may vary in accordance with particular needs without departing from the scope of the present invention. Also, securement means other than the glue lines disclosed may be utilized for attaching the described parts together without altering the substance of the invention.

Obviously, many modifications and variations of the invention are made possible in the light of the above teachings. It is therefore to be understood that within the scope of the appended claims the invention may be practiced otherwise than as specifically described.

What is claimed is:

1. A series-connected business form adapted to be fed through the printing means of a business machine, comprising a continuous pair of superimposed outer webs, said webs each having a row of spaced feed holes extending along at least one marginal edge thereof in superimposed relationship and being arranged to engage the feed means of the business machine so that the business form is thereby advanced into and past the printing means, said outer webs being attached together by first securement means adjacent said superimposed holes, at least one intermediate web lying between said outer webs and having one marginal edge thereof spaced inwardly of said superimposed feed holes, said outer webs having spaced transverse lines of weakening in superimposed relationship, said intermediate web having cut portions presenting opposite edges spaced inwardly of said transverse lines of weakening, said form being separable into individual units along said transverse lines, said intermediate web being attached to only one of said outer webs by second securement means extending longitudinally of the form, and said one of said outer webs having a first longitudinal line of weakening thereon located between said first and second securement means, whereby upon the printing of a number of said units, the next to the last of said units so printed may be separated along said transverse lines of weakening whereafter said one of said outer webs and said intermediate web attached thereto of the last of said printed units may be separated from the other of said outer webs thereof to thereby leave said other web of said last unit available as a drive web for initiating the feed of the remaining units to be printed through the printing means.

2. The business form according to claim 1, wherein said outer webs each having other rows of superimposed spaced feed holes provided along a marginal edge opposite said one marginal edge thereof for engaging the feed means of the business machine, said outer webs being attached together by third securement means adjacent said other row of superimposed feed holes, said one of said outer webs having a second longitudinal line of weakening thereon spaced inwardly of said third securement means, and said intermediate web having a marginal edge opposite said one marginal edge thereof spaced inwardly of said second longitudinal line of weakening.

3. The business form according to claim 2, wherein other intermediate webs are provided between said outer webs, said intermediate webs having superimposed third longitudinal lines of weakening thereon located inwardly of said second securement means, and said intermediate webs being attached together by fourth securement means lying between said first and third lines of weakening, whereby said intermediate webs may be separated from said one outer web.

* * * * *

REEXAMINATION CERTIFICATE (649th)

United States Patent [19]

Halse

[11] B1 4,113,281

[45] Certificate Issued Mar. 17, 1987

[54] CONTINUOUS BUSINESS FORMS ASSEMBLY

[75] Inventor: Per W. Halse, Oslo, Norway

[73] Assignee: Moore Business Forms, Inc., Niagara Falls, N.Y.

Reexamination Request:
No. 90/000,857, Sep. 17, 1985

Reexamination Certificate for:

| | |
|---|---|
| Patent No.: | **4,113,281** |
| Issued: | **Sep. 12, 1978** |
| Appl. No.: | **821,223** |
| Filed: | **Aug. 2, 1977** |

Related U.S. Application Data

[63] Continuation-in-part of Ser. No. 727,518, Sep. 28, 1976.

[51] Int. Cl.[4] ..... B41L 1/20

[52] U.S. Cl. ..... 282/11.5 A

[58] Field of Search ..... 252/11.5 R, 11.5 A, 252/12 R; 229/69

[56] References Cited

U.S. PATENT DOCUMENTS

| | | |
|---|---|---|
| 2,178,103 | 10/1979 | Johnson . |
| 2,328,081 | 8/1943 | Johnson . |
| 2,400,356 | 5/1946 | Kerr et al. . |
| 2,503,680 | 4/1950 | Newman . |
| 2,907,585 | 10/1959 | Sornberger et al. . |
| 3,104,799 | 9/1963 | Steidinger . |
| 3,305,247 | 2/1967 | Fulk . |
| 3,339,827 | 9/1967 | Steidinger . |
| 3,554,438 | 1/1971 | Van Maldergham . |
| 3,854,654 | 12/1984 | Van Maldergham . |
| 3,877,728 | 4/1975 | Herz . |
| 3,916,051 | 10/1975 | Wakeman . |
| 3,941,308 | 3/1976 | DiGirolomo et al. . |
| 4,000,916 | 1/1977 | Lucas . |
| 4,002,290 | 1/1977 | Van Maldergham . |
| 4,032,065 | 6/1977 | Heimann . |
| 4,095,695 | 6/1978 | Steidinger . |
| 4,108,352 | 8/1978 | Peschke . |
| 4,113,281 | 8/1978 | Halse . |
| 4,121,857 | 10/1978 | Halse . |
| 4,123,086 | 10/1978 | French . |
| 4,168,851 | 9/1979 | Halse . |
| 4,178,018 | 12/1979 | Halse . |

FOREIGN PATENT DOCUMENTS

| | | |
|---|---|---|
| 829450 | 1/1952 | Fed. Rep. of Germany . |
| 1042612 | 11/1958 | Fed. Rep. of Germany . |
| 974026 | 8/1960 | Fed. Rep. of Germany . |
| 1105889 | 5/1961 | Fed. Rep. of Germany . |
| 1172283 | 6/1964 | Fed. Rep. of Germany . |
| 1174807 | 7/1964 | Fed. Rep. of Germany . |
| 1256659 | 12/1967 | Fed. Rep. of Germany . |
| 1957983 | 5/1971 | Fed. Rep. of Germany . |
| 1461492 | 12/1966 | France . |
| 97462 | 1/1961 | Norway . |
| 126673 | 3/1973 | Norway . |
| 501396 | 2/1939 | United Kingdom . |
| 919496 | 2/1963 | United Kingdom . |
| 988148 | 4/1965 | United Kingdom . |
| 1006662 | 10/1965 | United Kingdom . |
| 1128634 | 9/1968 | United Kingdom . |
| 1154048 | 6/1969 | United Kingdom . |
| 1221969 | 2/1971 | United Kingdom . |
| 1286864 | 8/1972 | United Kingdom . |
| 1329063 | 9/1973 | United Kingdom . |
| 1376447 | 12/1974 | United Kingdom . |
| 1417683 | 12/1975 | United Kingdom . |
| 1418379 | 12/1975 | United Kingdom . |

*Primary Examiner*—Paul A. Bell

[57] ABSTRACT

A series of detachable business forms are adapted to be fed through the printing means of a business machine and each include a continuous pair of superimposed outer webs having spaced transverse lines of weakening to facilitate detachment. Intermediate webs forming a booklet disposed between the outer webs are secured to only one of the outer webs and are diecut transversely at the spaced transverse lines so that separation occurs only at the outer webs. At the end of a printing run the second to the last printed form may be separated from the last printed form along a longitudinal separation line of the one web, and the one web and its attached booklet of the last printed form may be removed from the other web thereof so that such other web is left as a drive web for the unprinted forms.

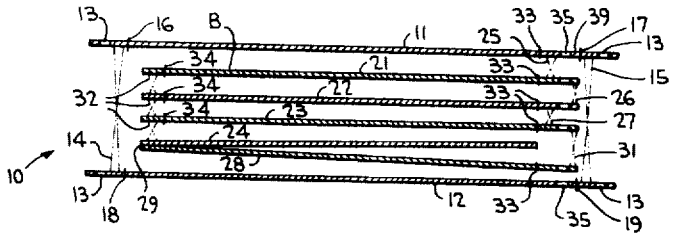

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 2–3 is confirmed.

Claim 1 is cancelled.

* * * * *